US006561265B2

(12) United States Patent
Ohira et al.

(10) Patent No.: US 6,561,265 B2
(45) Date of Patent: May 13, 2003

(54) HEAT EXCHANGER HAVING INTERMEDIATE HEATING MEDIUM

(75) Inventors: Hiroaki Ohira, Higashi-Ibaraki-gun (JP); Hitoshi Hayashida, Higashi-Ibaraki-gun (JP); Kuniaki Ara, Higashi-Ibaraki-gun (JP)

(73) Assignee: Japan Nuclear Cycle Development Institute, Ibaraki-ken (JP)

( * ) Notice: Subject to any disclaimer, the term of this patent is extended or adjusted under 35 U.S.C. 154(b) by 0 days.

(21) Appl. No.: 10/076,282

(22) Filed: Feb. 19, 2002

(65) Prior Publication Data

US 2003/0070794 A1 Apr. 17, 2003

(30) Foreign Application Priority Data

Oct. 15, 2001 (JP) ..... 2001-316513

(51) Int. Cl.[7] ..... F28D 7/10

(52) U.S. Cl. ..... 165/154; 165/157; 165/141; 165/11.1

(58) Field of Search ..... 165/154, 157, 165/159, 160, 140, 141, 11.1, 70

(56) References Cited

U.S. PATENT DOCUMENTS 2,658,728 A * 11/1953 Evans, Jr. ..... 165/11.1
3,306,353 A * 2/1967 Burne ..... 165/164
3,595,310 A * 7/1971 Burne ..... 165/159
3,942,589 A * 3/1976 Opitzer ..... 165/157
4,090,554 A * 5/1978 Dickinson ..... 165/11.1
4,228,848 A * 10/1980 Wadkinson ..... 165/70
4,233,812 A * 11/1980 Leistritz ..... 165/154
4,538,674 A * 9/1985 Schluderberg ..... 165/141
4,930,544 A * 6/1990 Ziu ..... 138/113
4,972,902 A * 11/1990 Ninomiya ..... 165/154
5,048,597 A * 9/1991 Bond ..... 165/41

FOREIGN PATENT DOCUMENTS

JP 53-131394 11/1978

* cited by examiner

*Primary Examiner*—Henry Bennett
*Assistant Examiner*—Tho Van Duong
(74) *Attorney, Agent, or Firm*—Wenderoth, Lind & Ponack, L.L.P.

(57) ABSTRACT

A heat exchanger having an intermediate heating medium is provided. A multiplicity of inner tubes 2 are disposed in a shell 1 of a heat exchanger 10. A low-temperature heating medium Y (water) flows in these inner tubes and a high-temperature heating medium X (liquid sodium) flows in the shell. These inner tubes are divided into a plurality of groups so that each group has a plurality of said inner tubes. The plural inner tubes constituting one group are disposed in one outer tube 3, and an intermediate heating medium Z chemically inactive with respect to both the high-temperature heating medium and the low-temperature heating medium and excellent in heat transferring performance is passed through each outer tube. The possibility that the high-temperature heating medium and the low-temperature heating medium contact each other can be reduced to an extremely low level. By providing leakage detectors capable of detecting with respect to each of the outer tubes the high-temperature heating medium or the low-temperature heating medium leaking out into the intermediate heating medium flowing out of the outer tubes, the damage to the inner tubes of each group can be detected and identified speedily.

18 Claims, 2 Drawing Sheets

HEAT EXCHANGER HAVING INTERMEDIATE HEATING MEDIUM

BACKGROUND OF THE INVENTION

This invention relates to a heat exchanger capable of being effectively used for heat exchange of liquid metal—water system conducted in, for example, a liquid-metal cooled reactor in which a high-temperature heating medium and a low-temperature heating medium are not allowed to contact each other, and more particularly to a heat exchanger adapted to conduct heat exchange via an intermediate heating medium chemically inactive with respect to both the high-temperature heating medium and low-temperature heating medium.

In a liquid-metal cooled reactor using, for example, liquid sodium as a coolant, heat exchange is carried out between a sodium system in which high-temperature sodium is circulated and a water-vapor system. In such a heat exchanger, when the sodium and water contact each other due to damage to a heat exchanger tube, both the sodium and water react with each other violently to get into danger of causing a disaster to occur.

As a means for preventing the sodium and water from immediately contacting each other even when damage to a heat exchanger tube occurs, a method of conducting heat exchange via a stable substance, which reacts with neither the sodium nor water, is proposed in, for example, Japanese Patent Laid-Open No. 53-131394A/1978.

In a heat exchanger concretely proposed in the above-described prior art, a heat exchanger tube is molded in the form of a double tube structure having an outer tube and an inner tube, and water (low-temperature heating medium) is passed through the inner tube with sodium (high-temperature medium) passed through a space on the outer side of an outer circumference of the outer tube. An annular portion between the inner tube and the outer tube is filled with a stable substance (intermediate heating medium) reacting with neither water nor sodium, for example, mercury, via which heat exchange is conducted.

According to the prior art heat exchanger described above, it has the effect of preventing owing to the presence of the intermediate heating medium the sodium and water from contacting each other immediately even when one of the outer tube and the inner tube of the doubly formed heat exchanger tube is damaged. However, since a clearance between the inner tube and the outer tube in the double tube structure is comparatively narrow, the possibility that the inner tube and the outer tube be damaged simultaneously is large. Furthermore, since the quantity of the intermediate heating medium flowing through the annular clearance is small, the possibility that the double tube structure is damaged to cause the sodium and water to contact each other cannot necessarily be eliminated sufficiently.

Moreover, since all the heat exchanger tubes are formed to double tube structures, the construction of the heat exchanger becomes complicated, and the manufacturing cost becomes high. In addition, when a certain doubly formed heat exchanger tube is damaged, it is necessary to examine all of the heat exchanger tubes one by one for the purpose of identifying the damaged heat exchanger tube, so that the speedy detection of a damaged heat exchanger tube cannot be carried out.

SUMMARY OF THE INVENTION

An object of the present invention is therefore to provide a heat exchanger having an intermediate heating medium, capable of reducing more greatly the possibility that sodium and water contact each other directly than the above-described prior art heat exchanger in which an outer tube and an inner tube are formed to a double tube structure with a clearance between the outer tube and the inner tube filled with an intermediate heating medium, having a simple heat exchanger tube structure as compared with the double tube structure, and capable of reducing the manufacturing cost.

Another object of the present invention is to provide a heat exchanger having an intermediate heating medium, capable of detecting and identifying a damaged outer tube or inner tube simply and speedily.

The heat exchanger having an intermediate heating medium according to the present invention includes a multiplicity of inner tubes disposed in a shell of a heat exchanger. A low-temperature heating medium flows in these inner tubes and a high-temperature heating medium flows in the shell. These inner tubes are divided into a plurality of groups each of which has a plurality of inner tubes. The plural inner tubes constituting one group are disposed in one outer tube, and an intermediate heating medium chemically inactive with respect to both the high-temperature heating medium and low-temperature heating medium and excellent in heat transferring performance is passed through each outer tube.

According to the heat exchanger of the present invention of such a structure, a multiplicity of inner tubes are divided into groups so that each group has, for example, 3 to 4 inner tubes, and one group having 3 to 4 inner tubes is housed simply in one outer tube. Therefore, this heat exchanger is structurally simple and can reduce the manufacturing cost as compared with the prior art heat exchanger having a double tube structure in which one outer tube and one inner tube are paired with each other.

Since around 3 to 4 inner tubes are disposed in one outer tube, it is unnecessary that a clearance between the outer tube and the inner tubes be formed as narrowly as that between the outer tube and the inner tube of the prior art double tube structure. Further, the interior of the outer tube can be filled with a large quantity of intermediate heating medium. Therefore, the possibility that the high-temperature heating medium (for example, sodium) and low-temperature heating medium (for example, water) contact each other can be reduced to an extremely low level even when any inner tube or the outer tube should be damaged.

Furthermore, since the intermediate heating medium having an excellent heat transferring performance is not only packed but also constantly circulated in a fluidized state in the interior of the outer tube, the performance of the intermediate heating medium of transferring heat from the high-temperature heating medium to the low-temperature heating medium is not substantially spoiled.

When any of the inner tube or the outer tube should be damaged to cause the low-temperature heating medium in the inner tube to leak into the outer tube, or the high-temperature heating medium in the outside of the outer tube to leak into the outer tube, it is necessary that the damage be detected speedily to thereby identify the damaged tube. To meet this requirement, leakage detectors capable of detecting in every outer tube the high-temperature heating medium or low-temperature heating medium leaking into the intermediate heating medium flowing out of the outer tube are provided in a preferred embodiment of the present invention. For example, when the leakage of the low-temperature heating medium into the intermediate heating medium flowing out of one specific outer tube is detected, it is possible to ascertain owing to the provision of these leakage detectors that one of the group of inner tubes in this outer tube is damaged. Therefore, the detection and identification of a damaged tube can be carried out speedily as compared with those carried out in the case where a multiplicity of inner tubes are examined one by one.

In a more preferred embodiment of the present invention, a partition tube is disposed on the inner side of an inner circumference of each outer tube to retain a clearance between the partition tube and the outer tube by positioning spacers between these tubes so that the intermediate heating medium can flow also through the clearance. Thus, even when the outer tube should be damaged, a danger of occurrence of direct contact of the high-temperature heating medium with the outer circumferences of the inner tubes can be further reduced owing to the partition tube disposed on the inner side of the outer tube. This structure serves as a desirable structure for reliably preventing, especially, in a heat exchanger of sodium—water system a danger of occurrence of the contact of the high-temperature heating medium and water with each other which causes a disaster to occur.

PREFERRED EMBODIMENTS OF THE INVENTION

Figure 1:
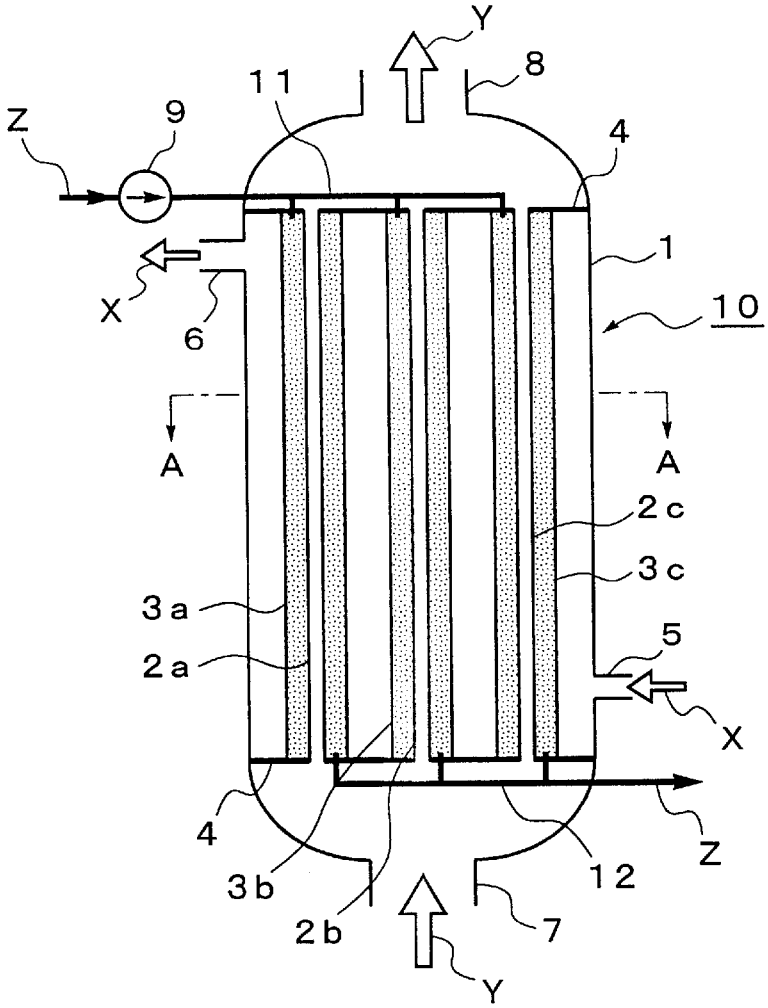
FIG. 1 is a longitudinal sectional view showing an embodiment of the heat exchanger according to the present invention.
Figure 2:
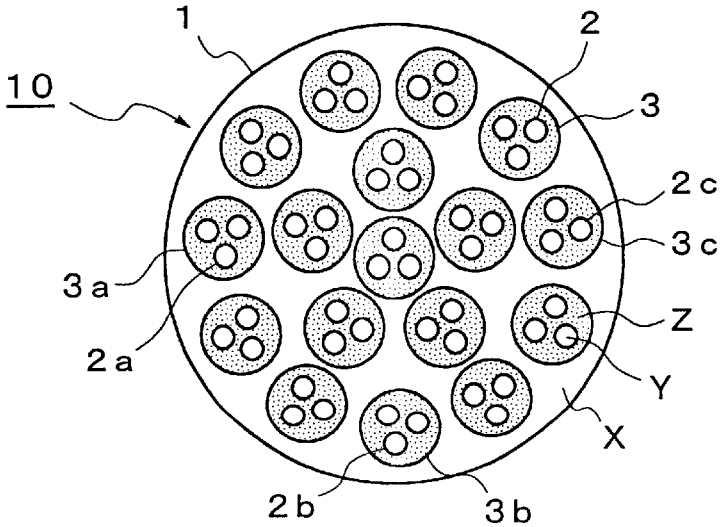
FIG. 2 is a cross-sectional view taken along the line A—A in FIG. 1.

FIG. 1 is a longitudinal sectional view showing an embodiment of the heat exchanger according to the present invention, and FIG. 2 a cross-sectional view taken along the line A—A in FIG. 1. As is understood from FIG. 2, a multiplicity of inner tubes 2 are disposed in a shell 1 of a heat exchanger 10, and these inner tubes 2 are divided into groups so that each group has a plurality (three in the illustrated embodiment) of inner tubes 2, the three inner tubes 2 constituting one group being housed in one outer tube 3. A high-temperature heating medium X (for example, liquid sodium) flows between the outer tubes 3,3 in the shell 1 of the heat exchanger, and a low-temperature heating medium Y (for example, water) in each inner tube 2, an intermediate heating medium Z flowing between the inner tubes 2,2 in each outer tube 3. The number of the groups into which the inner tubes are divided is determined depending upon an objective heat exchanger capacity.

The longitudinal sectional view of FIG. 1 is drawn in a simplified manner so as to have the embodiment understood easily, in which longitudinal sectional views of only the inner tube 2*a* and outer tube 3*a*, the inner tube 2*b* and outer tube 3*b*, and the inner tube 2*c* and outer tube 3*c* are representatively shown. As is understood from FIG. 1, the inner tubes 2 and outer tubes 3 are disposed between upper and lower tube plates 4, 4 of the heat exchanger 10. The high-temperature heating medium X enters the shell from an inlet 5 for the same heating medium at a lower portion of the shell 1, flows from a lower portion to an upper portion of the part of the interior of the shell 1 between the outer tubes 3,3 and flows out from an outlet 6 for the same heating medium at an upper portion of the shell 1. On the other hand, the low-temperature heating medium Y enters the shell from an inlet 7 for the same heating medium at a bottom portion of the heat exchanger 10, flows upward in the interior of each inner tube 2, and flows out from an outlet 8 for the same heating medium at a top portion of the heat exchanger 10. The intermediate heating medium Z flows into each outer tube 3 in a branching state via an upper branch pipe 11 provided with a pump 9, flows down between the inner tubes 2,2 in each outer tube 3, and flows out of the heat exchanger 10 via a lower confluence pipe 12.

According to the heat exchanger of such a structure, the high-temperature heating medium X flowing outside of the outer tubes 3 and the low-temperature heating medium Y flowing in the interior of the inner tubes 2 are subjected to heat exchange via the intermediate heating medium Z flowing inside of the outer tube 3. A liquid metal chemically inactive with respect to both the high-temperature heating medium X and low-temperature heating medium Y, and having a high heat transferring performance can be used preferably as the intermediate heating medium Z. When the high-temperature heating medium X and the low-temperature heating medium Y are sodium and water respectively, for example, liquid lead or liquid bismuth and the like can be used as the intermediate heating medium Z. Since the intermediate heating medium Z having a high heat transferring performance is selected, and this heating medium is circulated in a fluidized state in the outer tubes 3, the heat can be transmitted efficiently from the high-temperature heating medium X to the low-temperature heating medium Y via the intermediate heating medium Z.

Figure 3:
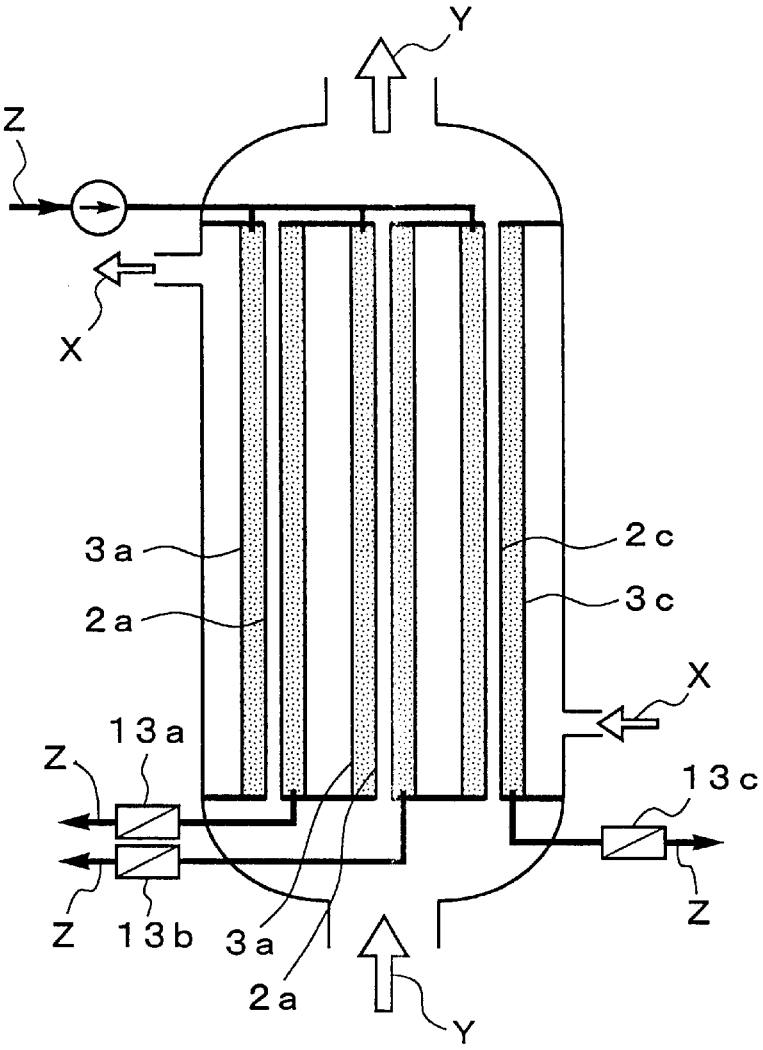
FIG. 3 is a longitudinal sectional view showing an embodiment of the heat exchanger provided with leakage detectors according to the present invention.

FIG. 3 shows an embodiment provided with leakage detectors adapted to detect the leakage of the heating media occurring due to the damage to the inner tubes 2 or outer tubes 3, and the same reference numerals are assigned to the parts identical with those of FIG. 1 to omit the description thereof. In the embodiment shown in FIG. 3, the leakage detectors 13*a* to 13*c* are provided in flow passages for the intermediate heating medium Z flowing out of the outer tubes 3*a* to 3*c*, and constantly watches the low-temperature heating medium Y or the high-temperature heating medium X leaking into the intermediate heating medium Z. Assuming that some one of the three inner tubes 2 housed in an outer tube 3*a* is damaged to cause the low-temperature heating medium Y flowing in the inner tube 2 to leak into the intermediate heating medium Z, the low-temperature heating medium Y leaking from the inner tube 2 is diffused into only the intermediate heating medium Z in one outer tube 3*a*. The range of diffusion of the low-temperature heating medium Y can therefore be reduced, and the leakage of this heating medium Y is detected by the detector 13*a*, the occurrence of the damage to the group of inner tubes 2 in the outer tube 3*a* being thereby ascertained immediately. It is also possible to carry out leakage detecting operations at predetermined time intervals by introducing the intermediate heating medium Z, which flows out of the outer tubes 3*a* to 3*c*, into one leakage detector 13 in order by a switching type method including a valve-operating action or the like without providing the leakage detectors 13*a* to 13*c* correspondingly to the outer tubes 3*a* to 3*c*.

Figure 4:
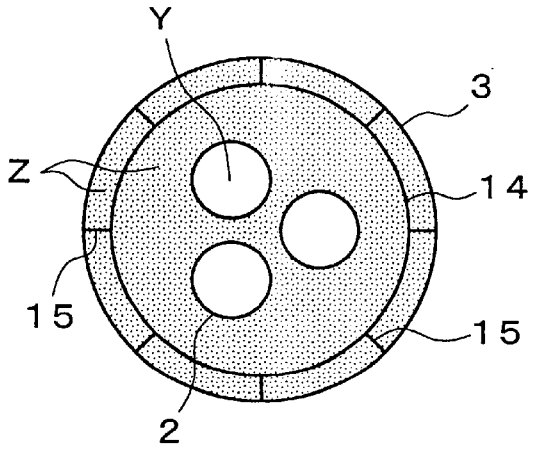
FIG. 4 is a cross-sectional view showing an outer tube which is provided with a partition tube on the inner side of an inner circumference thereof, and which is used for the heat exchanger according to the present invention.

FIG. 4 shows an embodiment specially desirable for a case where the contact of the high-temperature heating medium X and the low-temperature heating medium Y with each other needs to be prevented to a high degree, such as a case where liquid sodium and water are used as the high-temperature heating medium X and the low-temperature heating medium Y, respectively. In the embodiment shown in FIG. 4, a partition tube 14 the diameter of which is smaller than that of the outer tube 3 is diposed on the inner side of an inner circumference of the outer tube 3, and spacers 15 is positioned between the outer tube 3 and partition tube 14 so that a clearance of a predetermined width is retained between these two tubes, the intermediate heating medium Z being passed through this clearance as well. According to a structure in which such a partition tube 14 is disposed on the inner side of the inner circumference of the outer tube 3, the possibility that the high-temperature heating medium X flowing on the outer side of the outer tube 3 and the low-temperature heating medium Y flowing in the interior of the inner tubes 2 contact each other can be reduced to an extremely low level even when the outer tube 3 should be damaged, because the intermediate heating medium Z exists reliably between the partition tube 14 and inner tubes 2.

Although the above description is given with sodium and water taken as examples of the high-temperature heating medium and the low-temperature heating medium, respectively, the heat exchanger according to the present invention can be utilized not only as a heat exchanger of a sodium—water system but also widely as a heat exchanger of a system of a high-temperature heating medium and a low-temperature heating medium which are not allowed to contact each other.

According to the present invention which is understood from the description hereinabove, there is employed a structure formed by dividing a multiplicity of inner tubes into groups so that each group has a plurality of inner tubes, and disposing the plural inner tubes, which constitute one group, in one outer tube. This enables the construction of the present invention to be simplified, and the manufacturing cost to be reduced as compared with the construction in which one outer tube and one inner tube are paired with each other to form a double tube structure.

Moreover, it is unnecessary that a clearance between the outer tube and the inner tubes be formed as narrowly as that between the outer tube and the inner tube of a double tube structure, and a large quantity of intermediate heating medium can be made to flow in the outer tube. Therefore, when the inner tube or the outer tube should be damaged, the possibility that the high-temperature heating medium (for example, sodium) flowing outside of the outer tube and the low-temperature heating medium (for example, water) contact each other can be reduced to an extremely low level.

Furthermore, since the intermediate heating medium having an excellent heat transferring performance is not only packed but also circulated in a fluidized state in the interior of the outer tube, the heat can be transferred from the high-temperature medium to the low-temperature medium with a high efficiency via intermediate heating medium.

Furthermore, by providing the leakage detectors capable of detecting with respect to every outer tube the high-temperature heating medium or the low-temperature heating medium leaking into the intermediate heating medium flowing out of the outer tubes, damage to a specific outer tube or a certain one of the inner tubes in the outer tube can be ascertained, so that a damaged tube detecting and identifying operation can be carried out simply and speedily as compared with a similar damaged tube detecting and identifying operation carried out separately for every one of the multiple inner tubes.

Additionally, by disposing the partition tube on the inner side of the inner circumference of each outer tube, a danger of occurrence of direct contact of the high-temperature heating medium and the low-temperature heating medium with each other can be further reduced owing to the partition tube even when an outer tube should be damaged. Especially, in a heat exchanger of a sodium—water system, a danger of occurrence of contact of these two kinds of heating media which causes a disaster to occur can be prevented more effectively.

What is claimed is:

1. A heat exchanger comprising:

a shell;

at least one outer tube in said shell;

at least two inner tubes in said at least one outer tube; and a partition tube in said at least one outer tube, said partition tube defining a clearance between said partition tube and an inner periphery of said at least one outer tube, wherein a high-temperature heating medium is to flow through said shell, a low-temperature heating medium is to flow through said at least two inner tubes, and an intermediate heating medium is to flow through said outer tube and said clearance, with the intermediate heating medium being chemically inactive with respect to each of the high-temperature heating medium and the low-temperature heating medium and exhibiting excellent heat transferring characteristics.

2. The heat exchanger according to claim 1, further comprising a high-temperature heating medium in said shell, a low-temperature heating medium in said at least two inner tubes, and an intermediate heating medium in said at least one outer tube.

3. The heat exchanger according to claim 2, further comprising a leakage detector capable of detecting with respect to said at least one outer tube said high-temperature heating medium or said low-temperature heating medium leaking into said intermediate heating medium as said intermediate heating medium flows from said at least one outer tube.

4. The heat exchanger according to claim 3, wherein said partition tube surrounds said at least two inner tubes.

5. The heat exchanger according to claim 2, wherein said partition tube surrounds said at least two inner tubes.

6. The heat exchanger according to claim 1, wherein said partition tube surrounds said at least two inner tubes.

7. The heat exchanger according to claim 2, wherein said at least one outer tube comprises plural outer tubes, and said at least two inner tubes comprise at least two inner tubes in each of said plural outer tubes.

8. The heat exchanger according to claim 7, further comprising leakage detectors capable of detecting with respect to said plural outer tubes, respectively, said high-temperature heating medium or said low-temperature heating medium leaking into said intermediate heating medium as said intermediate heating medium flows from said plural outer tubes, respectively.

9. The heat exchanger according to claim 8, further comprising at least one spacer in said clearance to retain said clearance between said partition tube and said inner periphery of said respective said each of said plural outer tubes.

10. The heat exchanger according to claim 9, wherein said at least one spacer comprises plural spacers.

11. The heat exchanger according to claim 10, wherein said partition tube surrounds said at least two inner tubes in said respective said each of said plural outer tubes.

12. The heat exchanger according to claim 9, wherein said partition tube surrounds said at least two inner tubes in said respective said each of said plural outer tubes.

13. The heat exchanger according to claim 8, wherein said partition tube surrounds said at least two inner tubes in said respective said each of said plural outer tubes.

14. The heat exchanger according to claim 7, further comprising at least one spacer in said clearance to retain said clearance between said partition tube and said inner periphery of said respective said each of said plural outer tubes.

15. The heat exchanger according to claim 14, wherein said at least one spacer comprises plural spacers.

16. The heat exchanger according to claim 15, wherein said partition tube surrounds said at least two inner tubes in said respective said each of said plural outer tubes.

17. The heat exchanger according to claim 14, wherein said partition tube surrounds said at least two inner tubes in said respective said each of said plural outer tubes.

18. The heat exchanger according to claim 7, wherein said partition tube surrounds said at least two inner tubes in said respective said each of said plural outer tubes.

* * * * *